US005462133A

United States Patent [19]

Merrill, Jr.; Warren R. et al.

[11] Patent Number: 5,462,133

[45] Date of Patent: Oct. 31, 1995

[54] STEP LADDER STABILIZER

[76] Inventors: Warren R. Merrill, Jr.; Jacqueline M. Taylor-Merrill, both of 105 Glendale St., Morganton, N.C. 28655

[21] Appl. No.: 326,248

[22] Filed: Oct. 20, 1994

[51] Int. Cl.[6] ..... E06C 5/36

[52] U.S. Cl. ..... 182/172; 182/111

[58] Field of Search ..... 182/172, 107–111

[56] References Cited

U.S. PATENT DOCUMENTS

| | | | |
|---|---|---|---|
| 2,652,184 | 9/1953 | Loucks | 182/172 |
| 4,175,641 | 11/1979 | Reyes | 182/172 |
| 4,872,529 | 10/1989 | Viets | 182/172 |
| 4,899,849 | 2/1990 | Levi | 182/172 |
| 4,926,968 | 5/1990 | Schumer | 182/172 |

FOREIGN PATENT DOCUMENTS

| | | | |
|---|---|---|---|
| 1351393 | 4/1902 | France | 182/172 |

*Primary Examiner*—Alvin C. Chin-Shue

[57] ABSTRACT

A stepladder stabilizer comprising a telescopically adjustable leg having an upper end and a lower end; a coupling mechanism for coupling the upper end of the leg to a stepladder and allowing the leg to be pivoted and rotated with respect the stepladder; limiting means for limiting the extent to which the leg can be pivoted and rotated; and a foot pivotally coupled to the lower end of the leg and having a gripping mechanism extended downwards therefrom for preventing the foot from slipping when placed on a recipient surface.

1 Claim, 4 Drawing Sheets

STEP LADDER STABILIZER

BACKGROUND OF THE INVENTION

1. Field of the Invention

The present invention relates to a step ladder stabilizer and more particularly pertains to maintaining a step ladder in an upright configuration when in use with a step ladder stabilizer.

2. Description of the Prior Art

The use of stabilizer devices is known in the prior art. More specifically, stabilizer devices heretofore devised and utilized for the purpose of stabilizing ladders are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 300,365 to Wallick, Jr. et al. discloses a step ladder. U.S. Pat. No. 3,454,132 to Platino et al. discloses a ladder step. U.S. Pat. 4,029,280 to Golz discloses a step ladder attachment. U.S. Pat. No. 4,175,641 to Reyes discloses a step ladder leg support. U.S. Pat. No. 5,052,515 to Nowlan discloses a ladder step support.

While these devices fulfill their respective, particular objective and requirements, the aforementioned patents do not describe a step ladder stabilizer that allows a step ladder to be stabilized for use and inherently limits its extension and rotation with respect to the step ladder.

In this respect, the step ladder stabilizer according to the present invention substantially departs from the conventional concepts and designs of the prior art, and in doing so provides an apparatus primarily developed for the purpose of maintaining a step ladder in an upright configuration when in use.

Therefore, it can be appreciated that there exists a continuing need for new and improved step ladder stabilizer which can be used for maintaining a step ladder in an upright configuration when in use. In this regard, the present invention substantially fulfills this need.

SUMMARY OF THE INVENTION

In the view of the foregoing disadvantages inherent in the known types of stabilizer devices now present in the prior art, the present invention provides an improved step ladder stabilizer. As such, the general purpose of the present invention, which will be described subsequently in greater detail, is to provide a new and improved step ladder stabilizer and method which has all the advantages of the prior art and none of the disadvantages.

To attain this, the present invention essentially comprises, in combination, a rectangular planar foot having an upper surface, a lower surface, gripping means coupled to the lower surface for preventing the foot from slipping when placed on a recipient surface, and a bracket coupled to the upper surface and extended upwards therefrom. A leg is provided. The leg includes an elongated straight rigid tubular lower segment having a sealed lower end and an open upper end with the lower end pivotally coupled to the bracket of the foot to define a first swivel joint and with the upper end having a threaded hole disposed therethrough. The leg also includes an elongated straight rigid cylindrical upper segment having an upper end and a lower end with the lower end telescopically received within the upper end of the lower leg. A bracing joint is included and has a first section adapted to be coupled to a stepladder and a second section axially rotatably mated with the first section and pivotally coupled to the upper end of the upper leg to thereby create a second swivel joint for allowing the upper leg to be pivoted and rotated with respect to a stepladder when coupled thereto. A pair of chains is included with each chain having a first end coupled to the lower leg near its upper end and a second end couplable to a separate leg of the stepladder for limiting the extent to which the leg can be rotated or pivoted with respect to the stepladder. Lastly, a removable locking pin is included and has a threaded tip end and a handle end and with the tip end threadedly disposed within the threaded hole of the lower leg and abuttable against the upper segment when tightened for setting the extension of the leg.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved step ladder stabilizer which has all the advantages of the prior art stabilizer devices and none of the disadvantages.

It is another object of the present invention to provide a new and improved step ladder stabilizer which may be easily and efficiently manufactured and marketed.

It is a further object of the present invention to provide a new and improved step ladder stabilizer which is of durable and reliable construction.

An even further object of the present invention is to provide a new and improved step ladder stabilizer which is susceptible of a low cost of manufacture with regard to both materials and labor, and which accordingly is then susceptible of low prices of sale to the consuming public, thereby making such a step ladder stabilizer economically available to the buying public.

Still yet another object of the present invention is to provide a new and improved step ladder stabilizer which provides in the apparatuses and methods of the prior art some of the advantages thereof, while simultaneously overcoming some of the disadvantages normally associated therewith.

Even still another object of the present invention is to provide a new and improved step ladder stabilizer for maintaining a step ladder in an upright configuration when in use.

Lastly, it is an object of the present invention to provide a new and improved step ladder stabilizer comprising a telescopically adjustable leg having an upper end and a lower end; coupling means for coupling the upper end of the leg to a stepladder and allowing the leg to be pivoted and rotated with respect to the stepladder; limiting means for limiting the extent to which the leg can be pivoted and rotated; and a foot pivotally coupled to the lower end of the leg and having gripping means extended downwards therefrom for preventing the foot from slipping when placed on a recipient surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
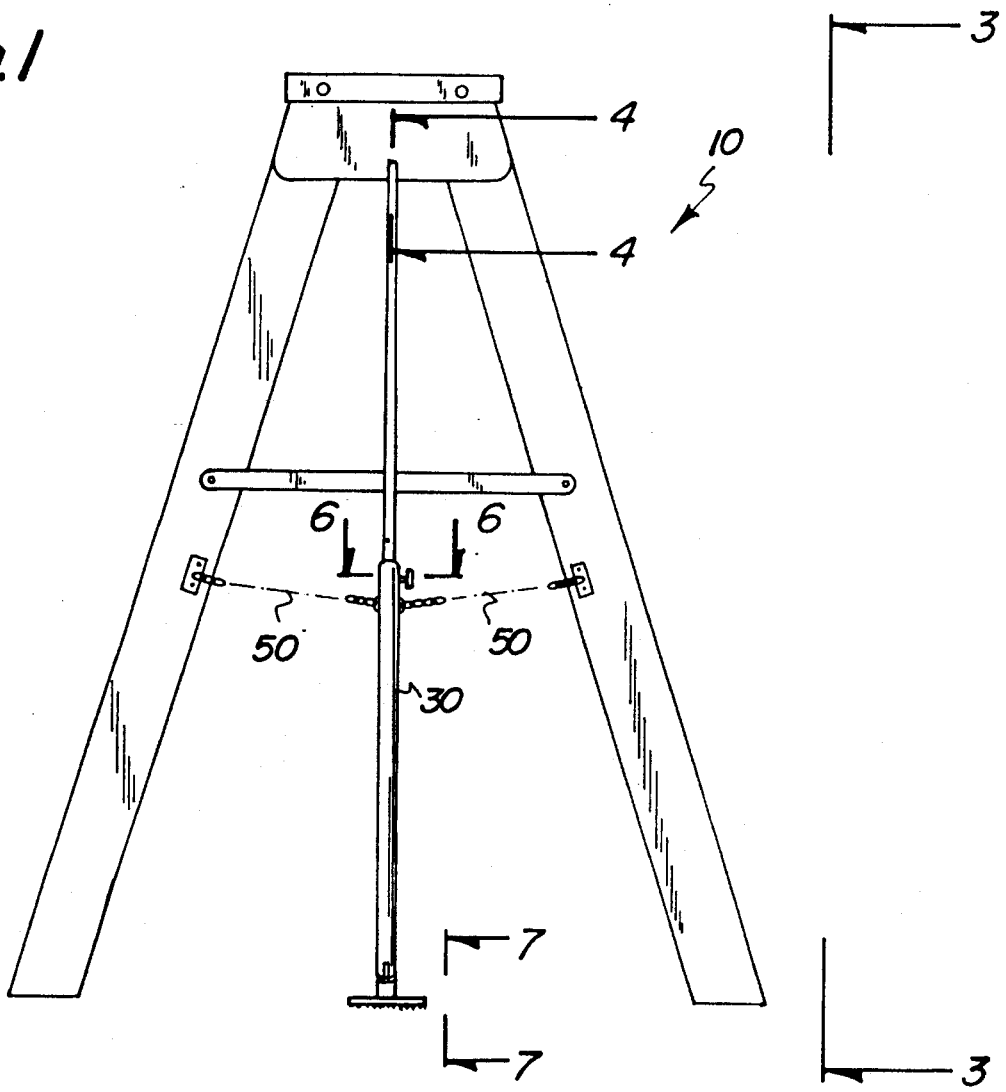
FIG. 1 is a side-elevational view of the preferred embodiment constructed in accordance with the principles of the present invention.
Figure 2:
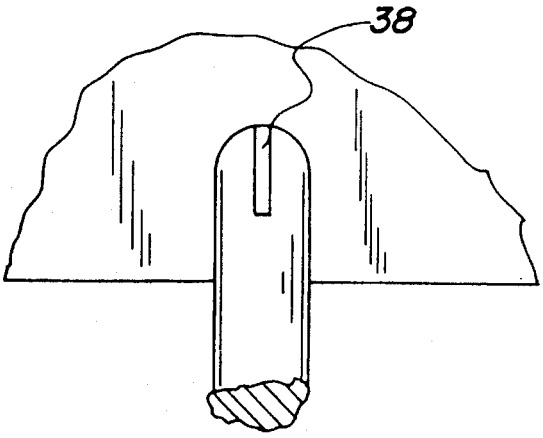
FIG. 2 is an enlarged view of the coupling of the upper end of the upper leg to a stepladder.
Figure 3:
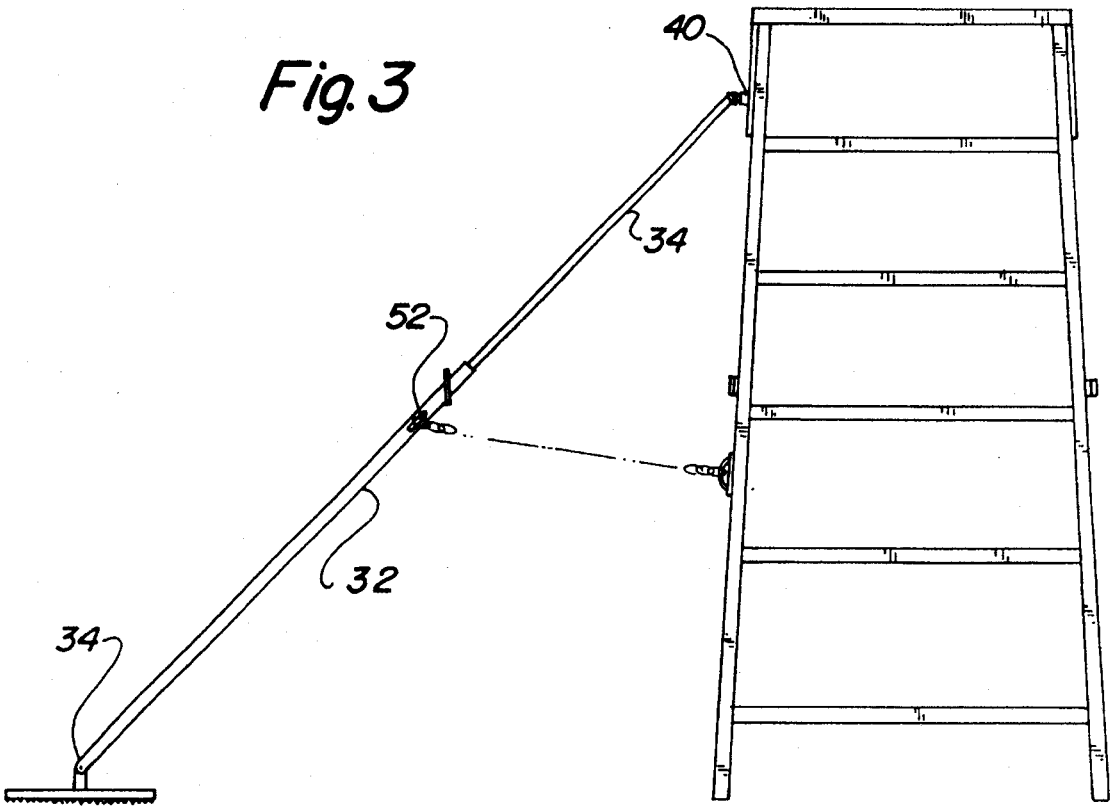
FIG. 3 is yet another side-elevational view of the present invention taken along the line 3—3 of FIG. 1.
Figure 4:
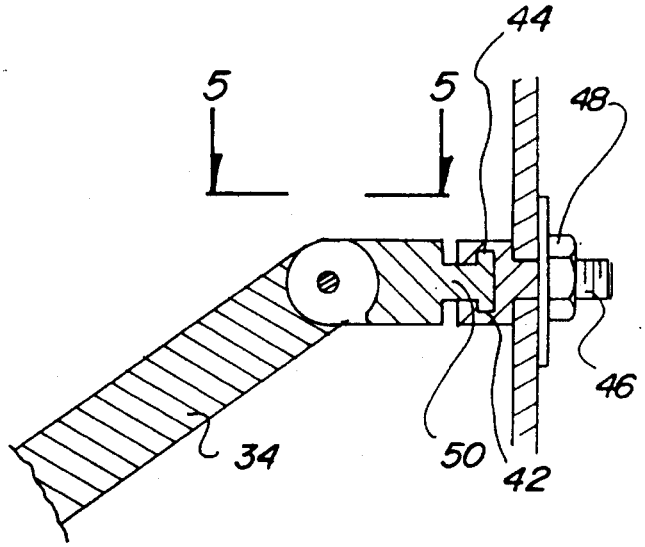
FIG. 4 is a cross-sectional view of the present invention taken along the line 4—4 of FIG. 1.
Figure 5:
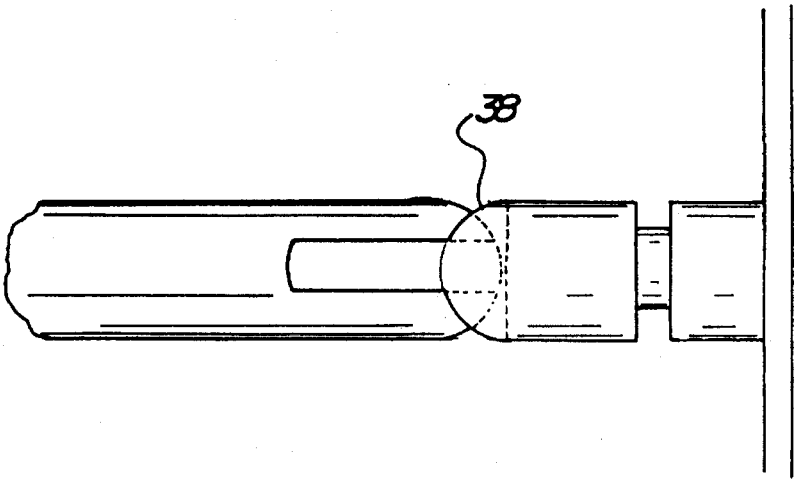
FIG. 5 is a plan view of the present invention taken along the line 5—5 of FIG. 4.
Figure 6:
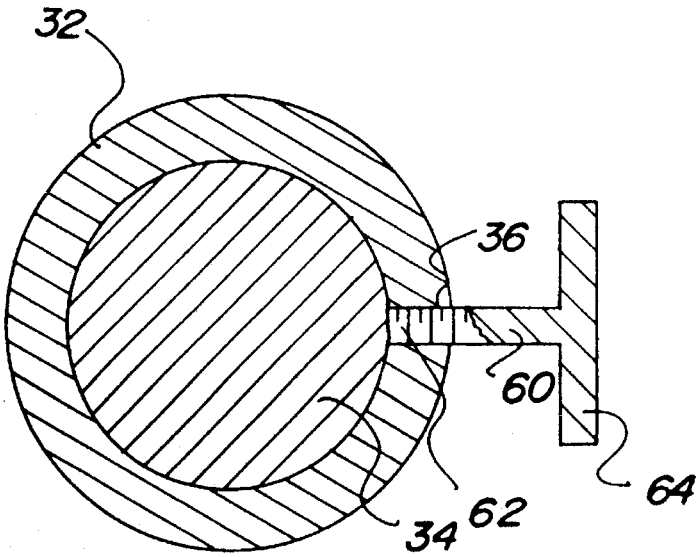
FIG. 6 is a cross-sectional view of the present invention taken along the line 6—6 of FIG. 1.
Figure 7:
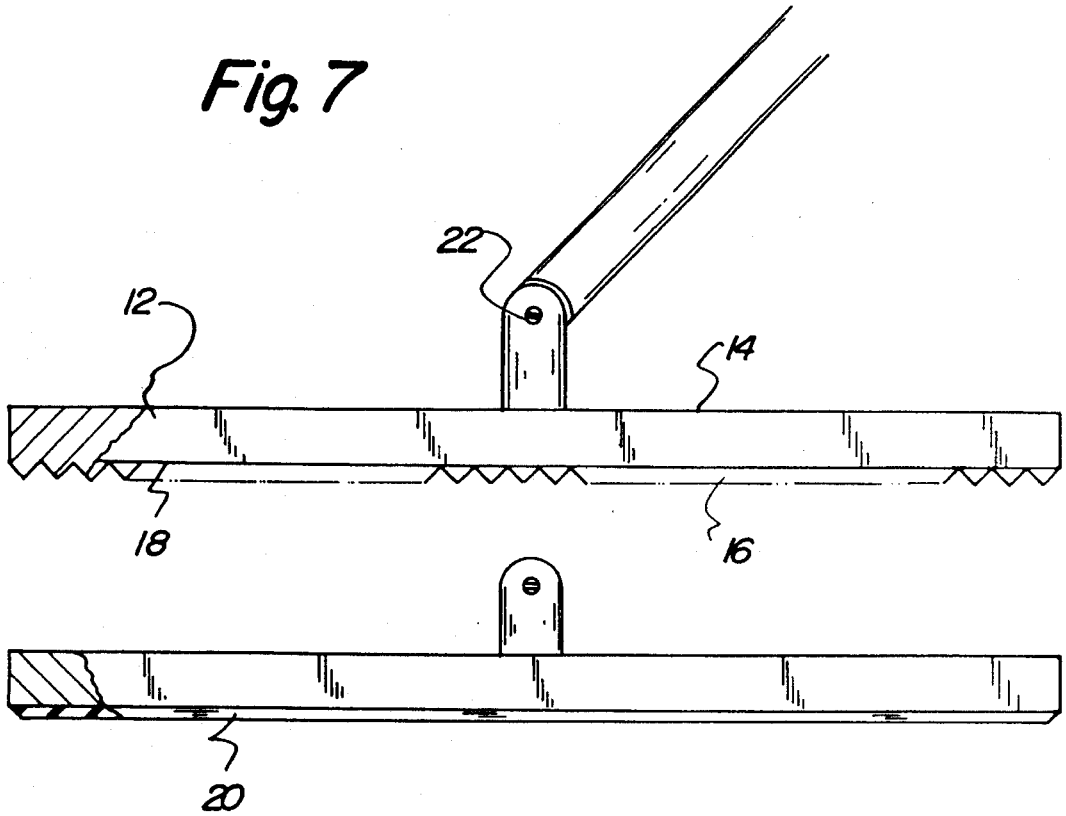
FIG. 7 is an enlarged side-elevational view of the present invention taken along the line 7—7 of FIG. 1.
Figure 8:
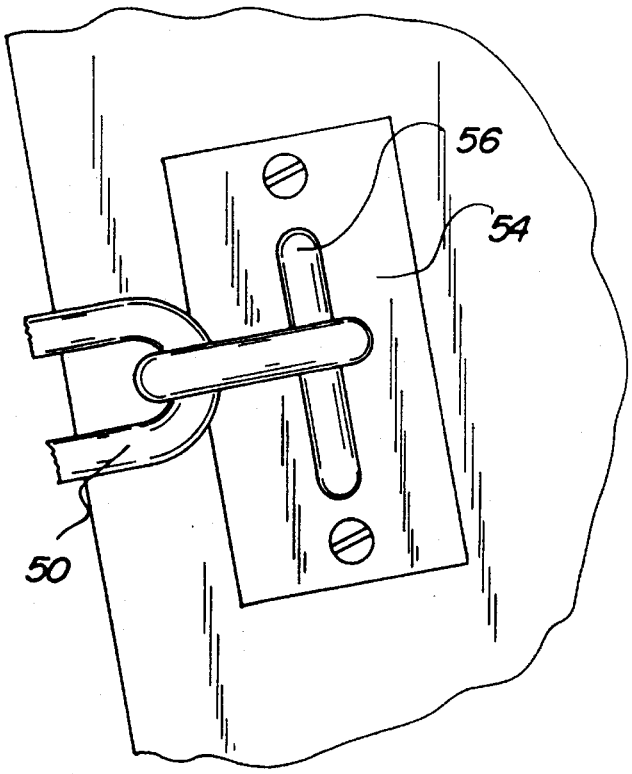
FIG. 8 is an enlarged side-elevational view of the coupling of a chain of the present invention to a leg of a stepladder.

With reference now to the drawings, and in particular, to FIG. 1 thereof, the preferred embodiment of the new and improved step ladder stabilizer embodying the principles and concepts of the present invention and generally designated by the reference number 10 will be described.

Specifically, the present invention essentially includes five major components. The major components are the foot, leg, bracing joint, chains and locking pin. These components are interrelated to provide the intended function of maintaining a step ladder in an upright configuration when in use.

More specifically, it will be noted in the various Figures that the first major component is the foot 12. The foot is rectangular and planar in structure. It is formed of a rigid material such as metal or plastic. The foot has an upper surface 14 and a lower surface 16. The foot also includes a gripping mechanism coupled to the lower surface for preventing the foot from slipping when placed on a recipient surface. In a one embodiment, this gripping mechanism is formed of a plurality of metal teeth 18 extended downwards from the lower surface for holding the foot in a stationary configuration on a surface such as grass. In the another embodiment, an elastomeric pad formed of rubber or other similar material is coupled to the lower surface for preventing the foot from slipping on a planar smooth recipient surface such as tile. The foot also includes a bracket 22 coupled to the center of the upper surface and extended upwards therefrom.

The second major component is the leg 30. The leg is formed of a rigid material such as metal or plastic. The leg includes an upper elongated cylindrical segment and a lower elongated tubular segment. The lower segment 32 has a sealed lower end and an open upper end. The lower end is pivotally coupled to the bracket of the foot to thereby define a first swivel joint 34. Rotation of the swivel joint is allowed to take place in a first imaginary vertical plane defined therethrough. Thus, the fist swivel joint thus has one degree of freedom which allows the pitch of the foot to be varied. The upper end of the lower segment has a threaded hole 36 disposed therethrough for receipt of a pin. The leg also includes an upper segment 38. The upper segment has an upper end and a lower end. The lower end of the upper segment is telescopically received within the upper end of the lower leg.

The third major component is the bracing joint 40. The bracing joint includes a first section 42. The first section is adapted to be coupled to a step ladder. The first section is essentially cylindrical in structure and includes an axial bore 44 formed therein. This bore has a generally T-shaped cross-section. The first section also includes a threaded bolt 46 extended at a location aligned with and remote from the bore. This bolt is coupled to a step ladder and secured with a nut 48. The bracing joint also includes a second section. The second section is essentially cylindrical in structure and includes an axial plug 50 disposed within the bore. The mating of the plug with the bore allows the second section to be rotated with respect to the first section. Rotation is allowed to take place in a second imaginary vertical plane defined through the point of coupling of the plug with the bore. The end of the second section remote from the plug is pivotally coupled to the upper end of the upper leg 34 to thereby create a second swivel joint 38. Pivotal rotation between the second section and the upper leg is allowed to take place in a third imaginary vertical plane coplanar with the first imaginary plane and perpendicular to the second imaginary plane. Thus, the second swivel joint has two degrees of freedom for allowing the upper leg to be pivoted and rotated with respect to a step ladder when coupled thereto.

The fourth major component is the chains 50. The present invention includes a pair of chains. The pair of chains are each formed of a plurality of interconnected links formed of a rigid material such as metal or plastic. Each chain has a first end coupled to the lower leg near its upper end with a coupling bracket 52. The second end of the chain is coupleable to a separate leg of the step ladder with another coupling bracket. Each coupling bracket is formed of a base plate 54 with a U-shaped eyelet 56 extended outwards therefrom. The base plate is coupled to a recipient surface with screws or bolts. The chains are intended to be extended outwards from the leg in diametric opposition for coupling with a stepladder. When the chains are coupled to a step ladder, they limit the extent to which the leg can be pivoted and rotated with respect to the step ladder, thereby helping to ensure safe use of the present invention.

The fifth major component is the locking pin 60. The locking pin is essentially T-shaped in structure and formed of a rigid material such as metal or plastic. The locking pin has a threaded tip end 62 and a handle end 64. The tip end is threadably disposed within the threaded hole of the lower leg. The tip end is abuttable against the upper segment when tightened by the handle and for setting the extension of the leg.

The present invention is a stabilizing device that supports and steadies a stepladder when it is being used. The present invention consists of an adjustable bracing joint that attaches to a stepladder's legs, a telescopically adjustable leg, and a foot. In the preferred embodiment, all the components of the present invention are made of aluminum. The present invention includes two interchangeable feet. One of the feet is formed with a non-skid rubber surface and the other with cleats or spikes. A pivotable bracing joint is coupled to a stepladder at a location where the legs of the stepladder intersect. The leg is formed of an upper segment and lower segment. The leg is connected to the bracing joint at one end and has the foot pivotally attached to its other end. The leg is adjustable lengthwise to accommodate different height stepladders. When positioned to support a stepladder, the leg slopes out at approximately a 45 degree angle. The chains are of length to accommodate this angle. The rubber pad is used at the end of the foot when the stepladder is standing on a floor and the spiked or cleated foot is used when the stepladder is used on turf or grass. The stabilizer's leg is extended out approximately 45 degrees and adjusted to the appropriate length on its foot. The present invention stabilizes a stepladder and keeps it from falling, whether it is used on a floor or the ground. The present invention also prevents the stepladder from swaying when the user is standing on or near its top.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A stepladder stabilizer for maintaining a stepladder in an upright configuration when in use comprising, in combination:

a pair of interchangeable rectangular horizontally positioned planar feet, each of the feet having an upper surface, a lower surface, and a bracket coupled to the upper surface and extended upwards therefrom with one foot further having a plurality of teeth extended downwards from the lower surface thereof and with the other foot further having a pad coupled to the lower surface thereof;

a leg further comprising:

an elongated straight rigid tubular lower segment having a sealed lower end and an open upper end with a threaded hole disposed therethrough, the lower end pivotally removably coupled to the bracket of one of the feet to define a first swivel joint that allows rotation of the lower segment in a first vertical plane; and an elongated straight rigid cylindrical upper segment having an upper end and a lower end with the lower end telescopically received within the upper end of the lower leg;

a bracing joint having a first section and a second section, the first section further having a cylindrical shape and an axial bore formed thereon with a T-shaped cross section and a threaded bolt extended therefrom at a location aligned with and remote from the bore and with the bolt couplable to a step ladder through the use of a nut, the second section further having a cylindrical shape with an axial plug formed thereon and disposed within the bore of the first section and an end pivotally coupled to the upper end of the upper segment to thereby create a second swivel joint that allows the leg to be rotated in a second vertical plane that is positioned in perpendicular alignment with the first plane and also allows the leg to be rotated in a third plane that is positioned in coplanar alignment with the first plane, thereby providing two degrees of freedom;

a pair of chains with each chain having a first end coupled to the lower leg near its upper end with a coupling bracket and a second end couplable to a separate leg of the stepladder with another coupling bracket with each coupling bracket formed of a base plate and a U-shaped eyelet extended outwards from the base plate and with the chains used for limiting the extent to which the leg can be pivoted and rotated; and a locking pin having a threaded tip end and a T-shaped handle end and with the tip end threadedly disposed within the threaded hole of the lower leg and abuttable against the upper segment when tightened for setting the extension of the leg.

* * * * *